United States Patent [19]

Perr

[11] 4,093,046

[45] June 6, 1978

[54] EXHAUST BRAKING APPARATUS

[75] Inventor: Julius P. Perr, Columbus, Ind.

[73] Assignee: Cummins Engine Company, Inc., Columbus, Ind.

[21] Appl. No.: 755,970

[22] Filed: Dec. 30, 1976

[51] Int. Cl.[2] ..... F02D 9/06

[52] U.S. Cl. ..... 188/273; 123/97 B

[58] Field of Search ..... 123/97 B; 188/154, 273

[56] References Cited

U.S. PATENT DOCUMENTS

| | | | |
|---|---|---|---|
| 1,577,466 | 3/1926 | Hyre | 188/273 |
| 2,767,697 | 10/1956 | Udale | 123/97 B |
| 3,042,153 | 7/1962 | Alfieri | 188/273 |

FOREIGN PATENT DOCUMENTS

| | | | |
|---|---|---|---|
| 299,198 | 9/1919 | Germany | 123/97 B |

*Primary Examiner*—Duane A. Reger

*Attorney, Agent, or Firm*—Neuman, Williams, Anderson & Olson

[57] ABSTRACT

A modulated exhaust braking apparatus is provided for use on a motor vehicle engine. The apparatus is connected to and forms a part of the engine exhaust system and produces minimum back pressure when the apparatus is in its open position. The apparatus includes a first chamber which separates an exhaust duct into two sections. One section is connected to an inlet for the first chamber and the second section of the duct is connected to an outlet formed in the first chamber. A closure member is adjustably mounted within the first chamber and, when in one position of adjustment, closes off communication within the first chamber between the inlet and outlet thereof. Pneumatic pressure responsive means is adjustably mounted within a second chamber separated from the first chamber. Adjustment of the closure member to a close off position and retention thereof in said close off position is dependent upon regulated pneumatic pressure exerted on the pressure responsive means. Adjustment of the closure member from a close off position to an open position wherein the inlet and outlet are in communication with one another is dependent upon the pressure of the exhaust gas upstream of the first chamber inlet.

6 Claims, 5 Drawing Figures

EXHAUST BRAKING APPARATUS

BACKGROUND OF THE INVENTION

In the operation of a heavy duty diesel truck, particularly when carrying a heavy load, it is imperative from safety and economical standpoints that an effective braking apparatus be provided which may be readily controlled by the driver. It has been found helpful in this regard, to utilize the engine as an air pump discharging against a blocked exhaust passage to slow down the engine and accordingly the speed of the vehicle and, thus, enable the wheel brakes to function more positively and at the same time prolong the life of the brake shoes or discs which engage the wheels of the vehicle.

Various exhaust braking apparatus have heretofore been provided; however, due to various design characteristics they have been beset with one or more of the following shortcomings: a) the apparatus is of costly and complex construction, b) it is difficult and/or awkward for the driver to operate properly, c) it is incapable of modulating the apparatus to compensate for various operating conditions of the engine, and d) it is highly susceptible to malfunction requiring and inordinate amount of servicing and maintenance. In addition, exhaust braking apparatus of the butterfly type cannot be made sufficiently free from leakage and/or seizure to make them reliable and capable of substantial braking forces.

SUMMARY OF THE INVENTION

Thus, it is an object of the invention to provide an exhaust braking apparatus which avoids the aforementioned shortcomings.

It is a further object of the invention to provide an exhaust braking apparatus which is of simple, compact construction and may be readily installed on various size motor vehicle engines.

Further and additional objects will appear from the description, accompanying drawings and appended claims.

In accordance with one embodiment of the invention, an exhaust braking apparatus is provided which is adapted to be installed within the exhaust duct of a motor vehicle engine. The apparatus includes a first chamber which is disposed within an exhaust duct and separates the latter into two complemental sections. A first duct section is connected to an inlet for the first chamber and a second section of the exhaust duct is connected to an outlet for the first chamber. Adjustably mounted within the first chamber is a closure member which, when in one position of adjustment, closes off the communication between the inlet and outlet within the first chamber. A pneumatic pressure responsive means is movably mounted within a second chamber separated from the first chamber. Movement of the responsive means is transmitted to the closure member. A source of regulated pneumatic pressure is connected to the second chamber and is adapted to exert a selected pneumatic pressure on the responsive means so as to effect movement thereof in one direction whereby the closure member is moved to and remains in a close off position within the first chamber. Adjustment of the closure member from the close off position to an open position is dependent upon the pressure of the exhaust gas upstream of the first chamber inlet.

DESCRIPTION

For a more complete understanding of the invention reference should be made to the drawings wherein.

Figure 1:
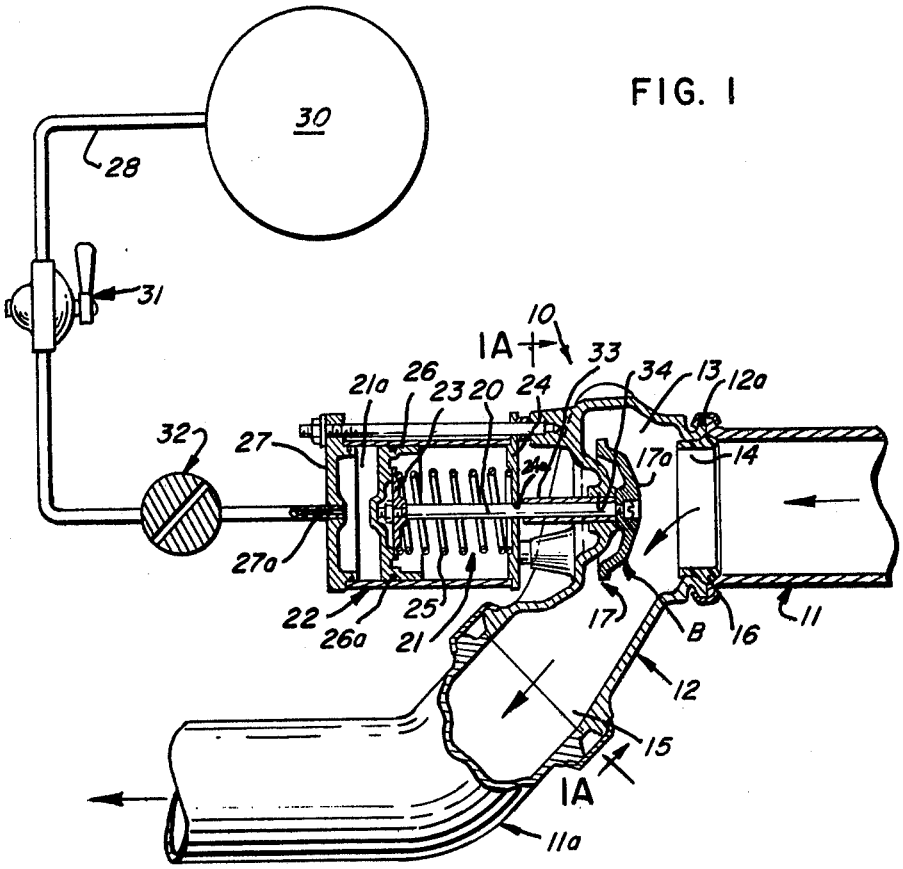
FIG. 1 is a fragmentary vertical sectional view of one form of the improved exhaust braking apparatus and showing the closure member thereof in its fully open position.
Figure 2:
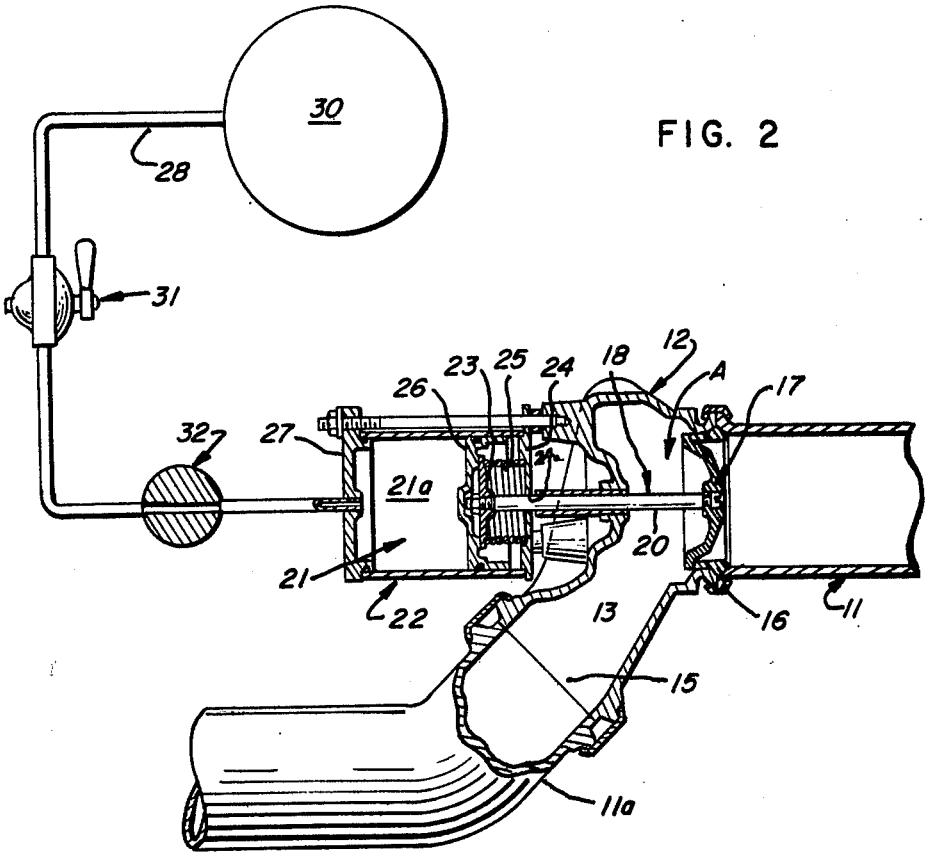
FIG. 2 is similar to FIG. 1 but showing the closure member in its fully closed position.

Referring now to the drawings and more particularly to FIGS. 1 and 2, one form of the improved exhaust braking apparatus 10 is shown which is adapted to be installed in the exhaust system of a motor vehicle engine, not shown. Where the engine embodies a turbocharger, the apparatus may be installed so as to communicate with the discharge side of the turbine section of the turbo charger. In instances where the engine does not embody a turbocharger, the apparatus 10 is connected to a section 11 of the duct leading from the exhaust manifold, not shown, normally provided on the engine.

Apparatus 10 includes a housing 12 having formed therein a first chamber 13. The housing is also provided with an inlet 14 for chamber 13 and an outlet 15 spaced from the inlet. The housing 12 embodies an external flange **12*a* which delimits the inlet 14. A similar external flange is also provided which delimits the outlet 15. The external flanges facilitate connecting the housing to exhaust duct sections 11 and 11*a*. A cylindrical valve seat 16 may be provided at the housing inlet 14** for a purpose to be hereinafter described.

Disposed within chamber 13 is an adjustably mounted closure member or valve 17. The size and configuration of member 17 are such that, when the member is in position A of adjustment, it will completely close off inlet 14, see FIG. 2, thereby interrupting communication between the inlet 14 and outlet 15. When member 17 is in position A, the periphery of surface **17*a* of the member will sealingly engage one end of valve seat 16, thereby preventing flow of exhaust gases into chamber 13**.

In apparatus 10, the adjustment of member 17 to position A is effected by a piston assembly 18. The assembly 18 includes an elongated rod 20 having one end thereof pivotally connected to member 17 thereby enabling the member to properly align itself with respect to valve seat 16. The opposite end of rod 20 terminates within a second chamber 21 formed in an auxiliary housing 22 affixed to the exterior of housing 12. An enlarged disc-shaped piece 23 is attached to the end of the rod and is disposed within chamber 21. Disposed between piece 23 and one end wall 24 of chamber 21 is a coil spring 25. As seen in FIGS. 1 and 2 spring 25 encompasses a portion of rod 20.

Disposed on the opposite side of piece 23 and engaging same is a piston member 26 which is slidably mounted within chamber 21 and is responsive to the pneumatic pressure developed within the portion **21*a* of chamber 21 disposed between member 26** and a second end wall 27 of the chamber 21. Member 26 carries a conventional O-ring type seal 26*a* which slidably engages the wall of housing 22. When the pneumatic pressure within chamber portion 21*a* is greater than the force exerted by spring 25 and the force of the exhaust gas upstream of inlet 14, the piston member 26, rod 20 and closure member 17 will move as a unit to the right, as viewed in FIG. 2, causing member 17 to assume its closed position A. Closure member 17 will remain in position A until the pressure of the fluid accumulated upstream of the inlet reverses the imbalance of pressures on member 17 and causes the latter to move away from its closed position A to a partially open or a fully open position B, as seen in FIG. 1. The extent to which closure member 17 is moved away from its fully closed position will depend upon the amount of pneumatic pressure within chamber portion 21*a*.

As noted in FIGS. 1 and 2, end wall 27 is provided with an opening 27*a* to which is connected a tube 28 leading to a tank 30 of compressed air. Such a tank is normally provided on the vehicle for operating air brakes and the like associated with the vehicle. Connected to tube 28 and located between the tank 30 and opening 27*a* are a modulating pressure regulating valve 31 and an on-off valve 32. The pneumatic pressure level to be maintained in chamber portion 21*a* may be determined by the manual setting of valve 31. Valve 32 may be operatively connected to the engine throttle and clutch, not shown, so as to automatically operate under certain engine operating conditions.

To provide proper support and sealing for rod 20 and at the same time enable it to move in an axial direction, a bearing sleeve 33 is mounted within an opening 34 formed in the wall of housing 12. An opening 24*a* is also provided in the end wall 24 of auxiliary housing 22 which is in axial alignment with opening 34.

Figure 1A:
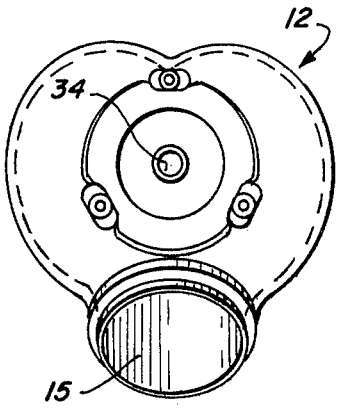
FIG. 1A is a view of the apparatus of FIG. 1 taken along line 1A—1A of FIG. 1.

As seen in FIG. 1A, the housing 12 has a heart-shaped configuration when viewed from the left side of FIG. 1. The purpose of this configuration is to minimize back pressure on exhaust pipe 11 when the brake is in its open position, i.e., when element 17 is displaced fully away from the seat 16. Because of the space limitations in the engine compartment the exhaust must end up in a circular pipe connecting to a pipe element 11*a*. When the brake is in its open position gases flow radially outward through an annulus defined between the valve seat 16 and the outer periphery of element 17. If housing 12 was not made in the heart-shaped configuration, the flow area for gases passing radially outward at the uppermost peripheral portion of element 17 (between the 11 o'clock and 1 o'clock positons), there would be a substantial reduction in the flow areas across the valve. By providing an additional flow path for gases radially outward adjacent these positions, the effective flow area is maintained at a reasonable level and assures a uniform flow passage past the valve element 17 to the opening 15.

Figure 3:
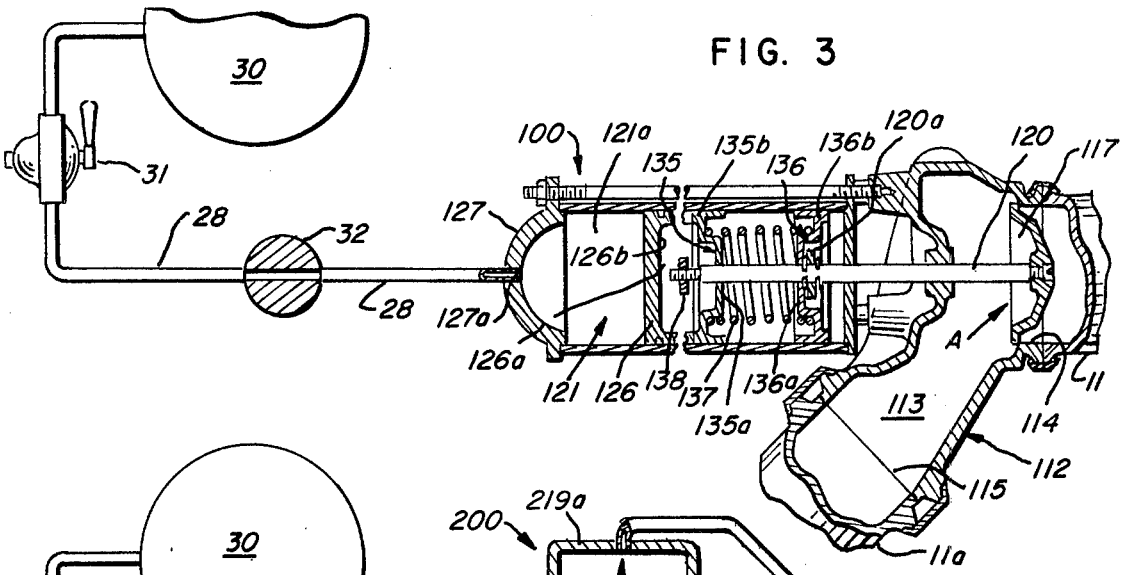
FIG. 3 is similar to FIG. 1 but showing a second form of the improved braking apparatus with the closure member thereof in a closed position.

A second form 100 of the improved exhaust braking apparatus is shown in FIG. 3. Components of apparatus 100 which correspond to the components of apparatus 10 will be identified by the same numeral but in the 100 series. Apparatus 100 includes a housing 112, similar in configuration to housing 12, having a first chamber 113 in which is disposed a closure member 117. The housing 112 is provided with an inlet 114 and an outlet 115 which are connected to corresponding exhaust duct sections 11 and 11*a*, respectively. The closure member 117 is connected to one end of an elongated rod 120 which is mounted to move in axial direction to effect either opening or closing of inlet 114 by closure member 117.

The opposite end of rod 120 terminates within a second chamber 121 formed in an auxiliary housing 122 which is suitably mounted on the exterior of housing 112. One end 127 of housing 122 is connected to a tube 28 leading to the source 30 of air pressure. As previously described with respect to apparatus 10, a pressure regulator valve 31 and an on-off valve 32 are provided in tube 28 between the source 30 and the connection to auxiliary housing 122.

Slidably mounted on the portion of the rod 120 disposed within second chamber 121 are pair of cuplike members 135, 136. Each member in the illustrated embodiment is of similar construction and has a base portion 135*a*, 136*a* provided with an opening through which the rod 120 slidably extends. The base portions 135*a*, 136*a* are disposed in longitudinally spaced opposed relation. The open end portion of each member is delimited by an outwardly projecting flange 135*b*, 136*b*. The outer periphery of each flange conforms substantially to the cross-sectional configuration of the interior wall surface defining chamber 121. Members 135, 136 are retained in axially spaced relation by a coil spring 137, the ends of which resiliently engage flanges 135*b*, 136*b*.

Member 136, which is disposed closest to closure member 117, engages a shoulder or abutment 120*a* formed on rod 120. Member 135, on the other hand, which is disposed closest to housing end wall 127, is engaged by a piston member 126. Member 126 is slidably disposed within the second chamber 121 and is located between end wall 127 and collar member 135. Member 126 is responsive to the pneumatic pressure established within chamber portion 121. Thus, movement of piston member 126 to the position as viewed in FIG. 3 would be transmitted to closure member 117 through member 135, spring 137, member 136, shoulder 120*a*, and rod 120. Once closure member 117 assumes its fully closed position A with respect to inlet 114, the force necessary to retain the closure member in such a position is determined by the spring force exerted on member 135, which, in turn, is dependent upon the relative position of the piston member 126 within chamber 121.

To prevent disengagement of member 135 from rod 120, a nut 138 is threaded onto the end of the rod terminating within chamber 121.

It will be noted that member 126 is provided with an interior cavity 126*a* in which one end of rod 120 terminates. The depth of the cavity is such that the end of the rod will not engage or be obstructed by the surface 126*b* of member 126 when the closure member 117 moves from its closed position A to its fully open position.

Figure 4:
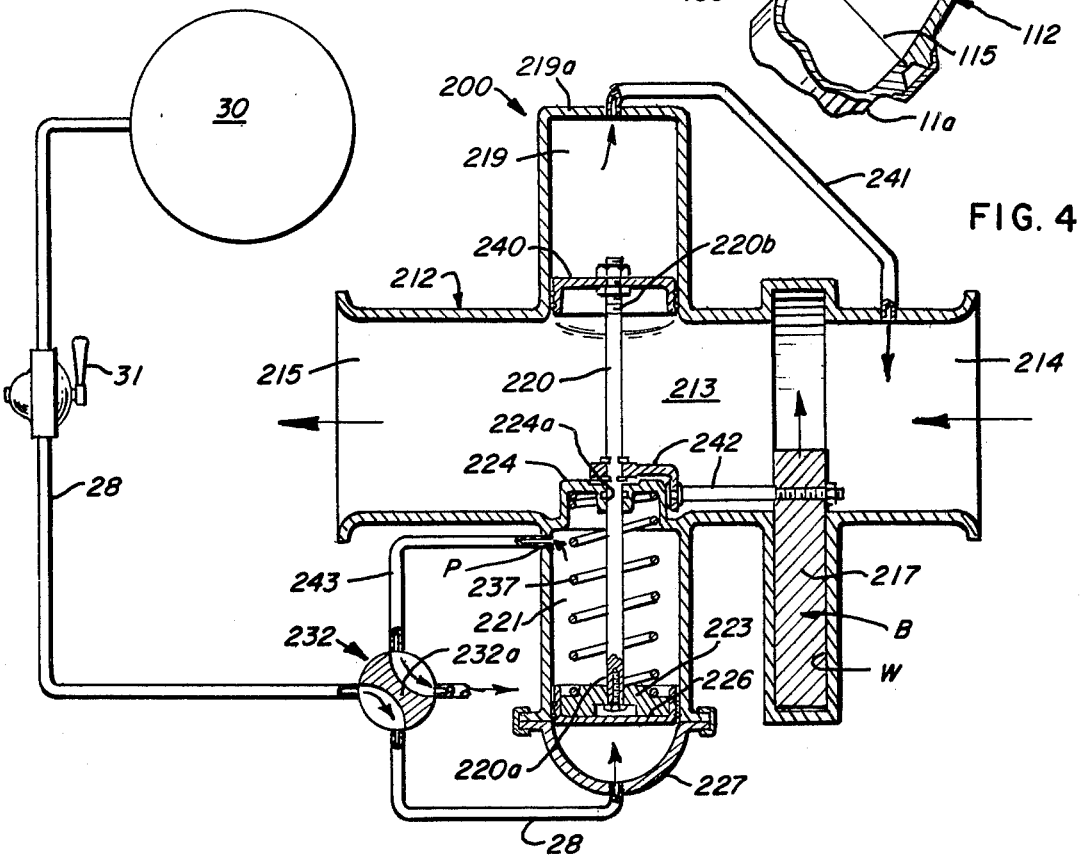
FIG. 4 is similar to FIG. 3 but showing a third form of the improved braking apparatus with the closure member thereof in a fully open position.

FIG. 4 illustrates a third embodiment 200 of the improved exhaust braking apparatus which is provided with a housing 212 having an inlet 214 and an outlet 215 which, in turn, are connected to corresponding exhaust duct sections, not shown. The inlet and outlet communicate with a first chamber 213 and with each other under certain conditions. Adjustably mounted within chamber 213 is a closure member or gate 217. The member 217 is adapted to move within a plane which is substantially normal to the direction of flow of the exhaust gases through inlet 214. When member 217 assumes its fully open position B, as seen in FIG. 4, a major portion of member 217 is disposed within a well W formed in a portion of chamber 213. On the other hand, when member 217 is in its fully closed position A, only a minor portion of member 217 remains within the well W. To prevent any appreciable escape of exhaust gases around member 217 and through well W, when the member is in its fully closed position, a substantially close fit is provided between the planar faces of member 217 and the adjacent walls of the well W.

The extended and retracted positions of closure member 217 with respect to well W, are affected by a reciprocably mounted rod 220 which has on one end 220*a* thereof terminating in a second chamber 221 and the opposite end 220*b* thereof terminating in a third chamber 219.

Affixed to rod end 220*a* and disposed within chamber 221 is an enlarged headpiece 223 which is resiliently engaged by one end of a coil spring 237. The opposite end of spring 237 engages partition 224 separating chambers 213 and 221. A piston member 226 is in sliding sealing engagement with the side wall defining chamber 221 and is in contact with head piece 223. The lower end wall 227 of chamber 221 is connected to a tank 30 of compressed air by means of tubing 28.

Partition 224 is provided with an opening 224*a* through which rod 220 slidably extends. Conventional sealing means is provided for opening 224*a* so as to prevent communication between chambers 213 and 221.

The upper end 220*b* of rod 220 has affixed thereto an enlarged head piece or piston 240 which is in sliding sealing engagement with the walls defining a third chamber 219. The upper end wall 219*a* of chamber 219 is connected by a tube section 241 to chamber 213 at a location upstream of closure member 217. Thus, when the pressure of the exhaust gas disposed upstream of the fully closed closure member 217 and the spring force of spring 237 are greater than the force of air pressure exerted on piston member 226, then the closure member 217 will automatically move away from its fully closed position A to a partially open or fully open position. The movement of rod 220 is transmitted directly to closure member 217 by a transversely extending arm or link 242. Other suitable ways of transmitting such movement may be utilized from that shown in FIG. 4. Because the mechanism (e.g. rod 220, headpieces 226, 240, spring 237, and piston member 226) is located on the downstream, low pressure side of closure member 217, the sliding engagement of the various components of the mechanism is subjected to minor pressure differentials, thereby significantly decreasing the possibility of the exhaust gas and its contaminants from entering chamber 221.

To facilitate movement of the headpiece 223 towards partition 224, a bleeder port P may be provided in the wall of chamber 221 adjacent to the partition 224. The port P, as shown in FIG. 4, is connected by a tube section 243 to an on-off valve 232. It will be noted, in this instance, that valve 232 includes a rotor 232*a* which, when in position of adjustment as shown, causes compressed air to enter the lower portion of chamber 221 while at the same time causes any air entrapped between headpiece 223 and partition 224 to be bled to the atmosphere through tube section 243 and a portion of valve 232.

Thus, it will be noted that an improved exhaust braking apparatus has been provided which is capable of being readily modulated so as to compensate for various operating conditions of the engine to which it is attached. The apparatus is of compact construction, simple in operation, may be readily installed on existing engines or new engines, and may be readily serviced when required.

I claim:

1. A modulating exhaust braking apparatus for a motor vehicle engine, comprising a first chamber disposed between a pair of complemental sections of an exhaust duct for the engine, said first chamber being provided with an inlet connected to one complemental duct section and an outlet connected to a second complemental duct section; closure means adjustably mounted within said first chamber for movement between first and second positions and, when in the first position, closing off exhaust gas flow through the first chamber and, when in the second position, permitting substantially unrestricted exhaust gas flow through the first chamber, said closure means being biased to normally assume said second position; a second elongated chamber separated from said first chamber and having one end wall thereof connected to a source of regulated pneumatic pressure; and a pneumatic pressure responsive means movably mounted within said second chamber, said responsive means having a surface portion remote from the second chamber end wall and operatively connected to said closure means, said responsive means effecting movement of said closure means from said second position to said first position and retaining same in said first position only when said responsive means is subjected to pneumatic pressure above a predetermined amount.

2. The braking apparatus of claim 1 wherein the pneumatic pressure responsive means includes a piston mounted for sliding sealing movement within the second chamber and an elongated rod connecting said piston to said closure means whereby said rod and closure means move substantially as a unit, the connection between said rod and closure means permitting the latter to be in a substantially self-aligning closed position with respect to the inlet of said first chamber, when said closure means is disposed in said first position.

3. The braking apparatus of claim 2 wherein the biasing means includes an abutment fixedly mounted on the elongated rod and spaced longitudinally from a first end thereof; a collar piece slidably encompassing the segment of the piston rod disposed between the abutment and said rod first end; and a coil spring encompassing the said rod segment and resiliently contacting at one end said collar piece and at a second end said abutment.

4. The braking apparatus of claim 3 wherein the abutment on the piston rod is engaged by a second collar piece slidably encompassing said piston rod segment, said second collar piece being disposed between the second end of said coil spring and said abutment.

5. The braking apparatus of claim 1 wherein the closure means includes a plate disposed within said first chamber and movable between inlet-opening and inlet-closing positions in a plane substantially normal to the direction of flow of the exhaust gas through the first chamber; and said pressure responsive means includes an elongated piston rod having a first end terminating within the second chamber and a second end terminating within a third chamber, the latter being axially aligned with said second chamber, a first piston operatively connected to said rod first end and mounted for sliding sealing movement within said second chamber and responsive to the source of regulated pneumatic pressure to move said rod in one direction and effect moving of said plate to the inlet closing position and, a second piston operatively connected to said rod second end and mounted for sliding sealing movement within said third chamber, and means interconnecting said plate and a portion of said rod disposed within said first chamber whereby said rod and said plate move as a unit but in spaced parallel planes; and a bypass passageway having one end thereof connected to said first chamber upstream of said plate, and a second end connected to said third chamber whereby, when said plate is in an inlet-closing position and the pressure of the exhaust gas upstream of the gate is above a predetermined amount, the upstream exhaust gas flows through said bypass passageway into said third chamber causing said second piston to move the piston rod in a second direction and said gate to an inlet-opening position.

6. The braking apparatus of claim 5 wherein the first chamber is provided with a transversely disposed well for accommodating therein a major portion of said gate, when the latter assumes an inlet-opening position, and a minor portion of said gate, when the latter assumes an inlet-closing position.

* * * * *